US006145335A

United States Patent [19]

Nagaoka

[11] Patent Number: 6,145,335

[45] Date of Patent: Nov. 14, 2000

[54] INDOOR UNIT OF AN AIR CONDITIONER

[75] Inventor: Shinji Nagaoka, Shiga, Japan

[73] Assignee: Daikin Industries, Ltd., Osaka, Japan

[21] Appl. No.: 09/341,263

[22] PCT Filed: Nov. 24, 1998

[86] PCT No.: PCT/JP98/05264

§ 371 Date: Jul. 7, 1999

§ 102(e) Date: Jul. 7, 1999

[87] PCT Pub. No.: WO99/27308

PCT Pub. Date: Jun. 3, 1999

[30] Foreign Application Priority Data

Nov. 26, 1997 [JP] Japan ..... 9-324348

[51] Int. Cl.[7] ..... F25D 21/00

[52] U.S. Cl. ..... 62/272; 62/407; 62/426

[58] Field of Search ..... 62/272, 419, 426, 62/407, 298, 262

[56] References Cited

U.S. PATENT DOCUMENTS 4,385,505 5/1983 Umezu et al. ..... 62/285

FOREIGN PATENT DOCUMENTS

| | | | |
|---|---|---|---|
| 0657701A2 | 6/1995 | European Pat. Off. . | |
| 0763698A1 | 3/1997 | European Pat. Off. . | |
| 54-82448 | 6/1979 | Japan . | |
| 56-112547 | 8/1981 | Japan . | |
| 59-40725 | 3/1984 | Japan . | |
| 6-109272 | 4/1994 | Japan | 62/272 |
| 6-147527 | 5/1994 | Japan | 62/272 |
| 6-14525 | 5/1999 | Japan | 62/272 |

*Primary Examiner*—William Doerrler
*Assistant Examiner*—Melvin Jones
*Attorney, Agent, or Firm*—Birch, Stewart, Kolasch & Birch, LLP

[57] ABSTRACT

An indoor unit for air conditioners of the invention has a front panel (4) having a suction grille (41) at least at a central portion (4*a*). Indoor air is sucked in through gaps (42) of the suction grille of the front panel (4), and cooled air is blown out into a room (99) through an air outlet (8) located below the front panel (4). A lower portion (4*b*) of the front panel (4) opposed to a lower portion (3*b*) of the front grille in proximity to an upper portion of the air outlet (8) is shaped to have dips and bumps. As a result, dew condensations on the front face side of the front panel lower portion can be prevented without causing any cost increase.

3 Claims, 2 Drawing Sheets

INDOOR UNIT OF AN AIR CONDITIONER

This application is the national phase under 35 U.S.C. §371 of PCT International Application No. PCT/JP98/05264 which has an International filing date of Nov. 24, 1998 which designated the U.S. of America.

TECHNICAL FIELD

The present invention relates to an indoor unit for air conditioners.

BACKGROUND ART

As shown in FIG. 2, a conventional indoor unit 101 of an air conditioner, in many cases, comprises a front grille 103 having a window 132 for ventilation in front of a heat exchanger 105, and further in front of the front grille 103, a front panel 104 having a suction grille (composed of a plurality of louvers 141) formed in its central portion 104*a* and an unshown upper portion. A front grille lower portion 103*b* and a front panel lower portion 104*b* are both flat-shaped and overlaid on each other. The front grille 103 is mounted integrally to a unit casing 102 while the front panel 104 is openable and closable to the unit casing 102. During cooling operation, a low-temperature refrigerant is made to flow through a heat exchanger tube 151 of the heat exchanger 105 of this indoor unit 101. In this state, with an air fan 106 driven into rotation, indoor air is sucked in through gaps 142 of the suction grille of the front panel 104 and the window 132 of the front grille 103, and air cooled through the heat exchanger 105 is blown out into a room 199 through an air outlet 108 located below the front panel 104.

A diffuser 109 having an inverted L-shaped cross section is provided at a position on a front panel 104 side within the air outlet 108, more specifically, between the front grille lower portion 103*b* and a drain pan front portion 107*a*. This diffuser 109, a horizontal portion 109*b* of which forms an upper wall of the air outlet 108, works to change kinetic energy fed to the blown-off air into pressure. Meanwhile, a generally flat-shaped guide vane 110 for changing the angle of the blown-off air is provided at a lower portion within the air outlet 108.

During the cooling operation, indoor air being higher in temperature and containing more moisture than the blown-off air makes contact with the front face side of the front panel lower portion 104*b*. As a result, in such an indoor unit 101 as described above, the front grille lower portion 103*b* and the front panel lower portion 104*b* are cooled by the blown-off air during the cooling operation, causing a problem that dew condensations 180 occur to the front face side of the front panel lower portion 104*b*. Particularly when the diffuser 109 is provided at a position on the front panel 104 side within the air outlet 108, the rear face side of the front panel lower portion 104*b* is cooled relatively strongly, making the dew condensations 180 more likely to occur to the front face side of the front panel lower portion 104*b*. Therefore, it has been conventional practice to apply a heat insulating material 112 on the rear face side of the front grille lower portion 103*b* overlaid on the front panel lower portion 104*b* in order to prevent the front panel lower portion 104*b* from being cooled from the rear face side by the blown-off air.

Also, the diffuser 109 has a temperature near the temperature of the blown-off air because the horizontal portion 109*b* is cooled by the blown-off air flowing through the air outlet 108. Therefore, high-temperature indoor air (indicated by the broken-line arrow in FIG. 2) that has entered to around a vertical portion 109*a* of the diffuser 109 is cooled, causing dew condensations to occur to the diffuser 109. Thus, as a conventional practice, heat insulating materials 113, 114 and unwoven cloth 15 are applied to the rear face of the vertical portion 109*a,* the lower face of the horizontal portion 109*b* and the upper face of the holizontal portion 109*b,* respectively, in the diffuser 109 so as to prevent involvement of warm air and thereby prevent dew condensations, while a heat insulating material 111 is applied also on the front face side of the drain pan front portion 107*a* facing the diffuser 109.

Like this, in the conventional indoor unit 101, a number of heat insulating materials or the like are used as measures for dew condensations in the vicinity of the front panel lower portion. This causes a cost increase, as a problem.

DISCLOSURE OF THE INVENTION

Therefore, an object of the present invention is to provide an indoor unit for air conditioners which is capable of preventing dew condensations on the front face side of the front panel lower portion without causing any cost increase.

In order to achieve the above object, according to the present invention, there is provided an indoor unit for an air conditioner, comprising a front panel having a suction grille at least at a central portion, and being operative to suck in indoor air through gaps of the suction grille of the front panel and to blow out cooled air into a room through an air outlet located below the front panel, characterized in that a lower portion of the front panel opposed to a lower portion of a front grille in proximity to an upper portion of the air outlet is shaped so as to have dips and bumps.

In the indoor unit for an air conditioner according to the present invention, since the front panel lower portion is shaped to have dips and bumps, the area of contact with indoor air increases on the front face side of the front panel lower portion. Therefore, as compared with the case where the front panel lower portion is flat-shaped, front-face side temperature (surface temperature). of the front panel lower portion rises higher. Also, as compared with the case where the front panel lower portion is flat-shaped, the area of contact between the front panel lower portion and the front grille lower portion becomes smaller, so that cold is less transferable from the front grille lower portion to the rear face side of the front panel lower portion. Accordingly, the front-face side temperature of the front panel lower portion rises further higher, so that dew condensations are less likely to occur to the front face side of the front panel lower portion. As a result of this, the heat insulating materials on the rear face side of the front grille lower portion overlaid on the front panel lower portion can be omitted, allowing a cost reduction.

In an aspect of the indoor unit for an air conditioner according to the present invention, the front panel lower portion shows the same appearance as the suction grille and has no gaps.

In this indoor unit for an air conditioner, because the front panel lower portion shows the same appearance as the suction grille, the front panel is not spoiled in its external look. Also, the front panel is easily manufactured by integral molding. In addition, because the front panel lower portion has no gaps, ventilation does not occur through the front panel lower portion, so that ventilation as it has been conventionally can be implemented.

In another aspect of the indoor unit for an air conditioner according to the present invention, a diffuser is provided at a position on one side in the air outlet closer to the front panel.

Generally, when the diffuser (which works to change kinetic energy fed to the blown-off air into pressure) is provided at a position on the front panel side within the air outlet, the blown-off air flows at a lower velocity on the rear face side of the front panel lower portion, so that the rear face side of the front panel lower portion is cooled relatively strongly, making dew condensations more likely to occur. In this indoor unit for an air conditioner, however, such dew condensations can be effectively excluded.

BEST MODE FOR CARRYING OUT THE INVENTION

Hereinbelow, an embodiment of the present invention is described in detail.

Figure 1:
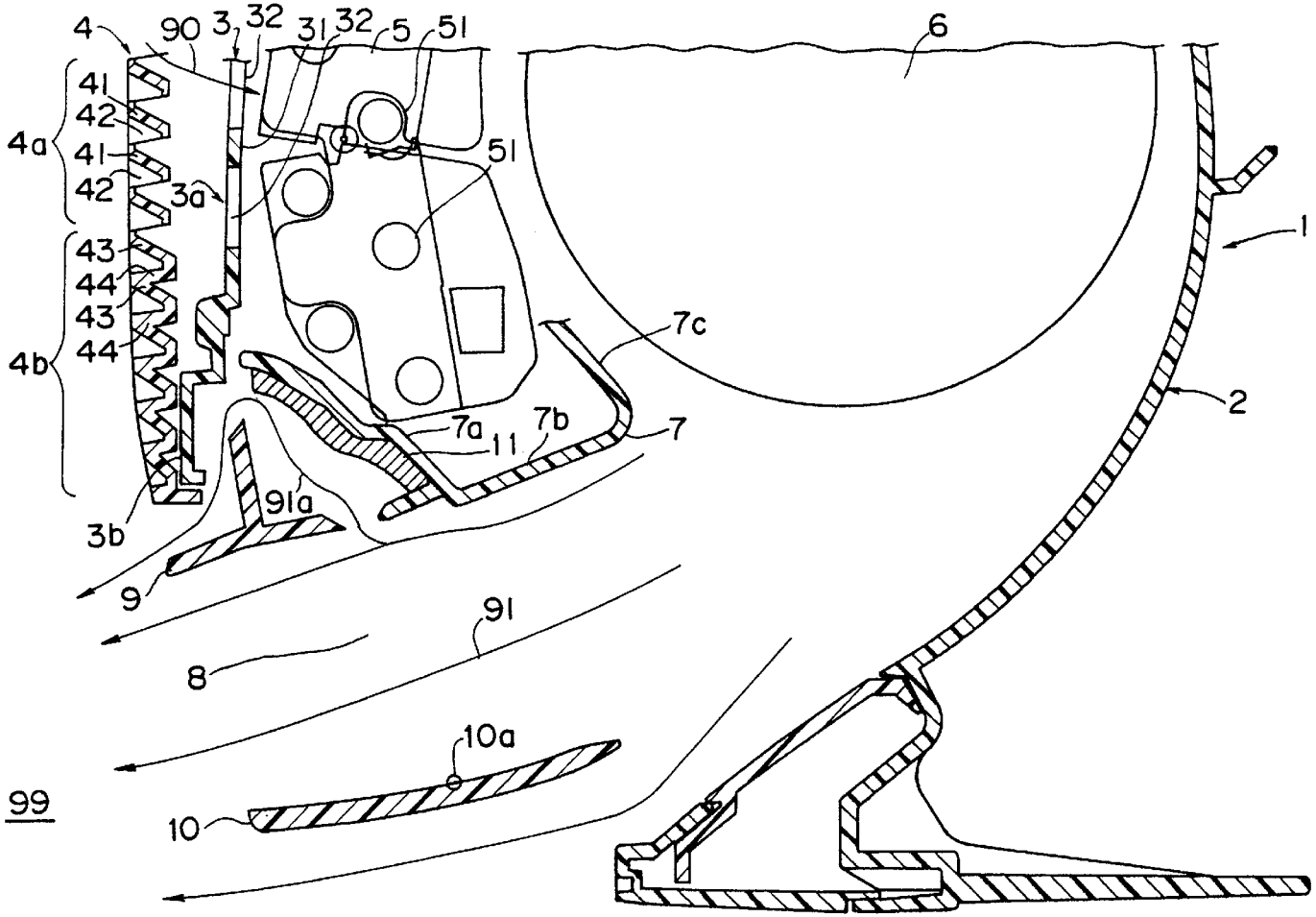
FIG. 1 is a sectional view showing an indoor unit for air conditioners according to an embodiment of the present invention.
Figure 2:
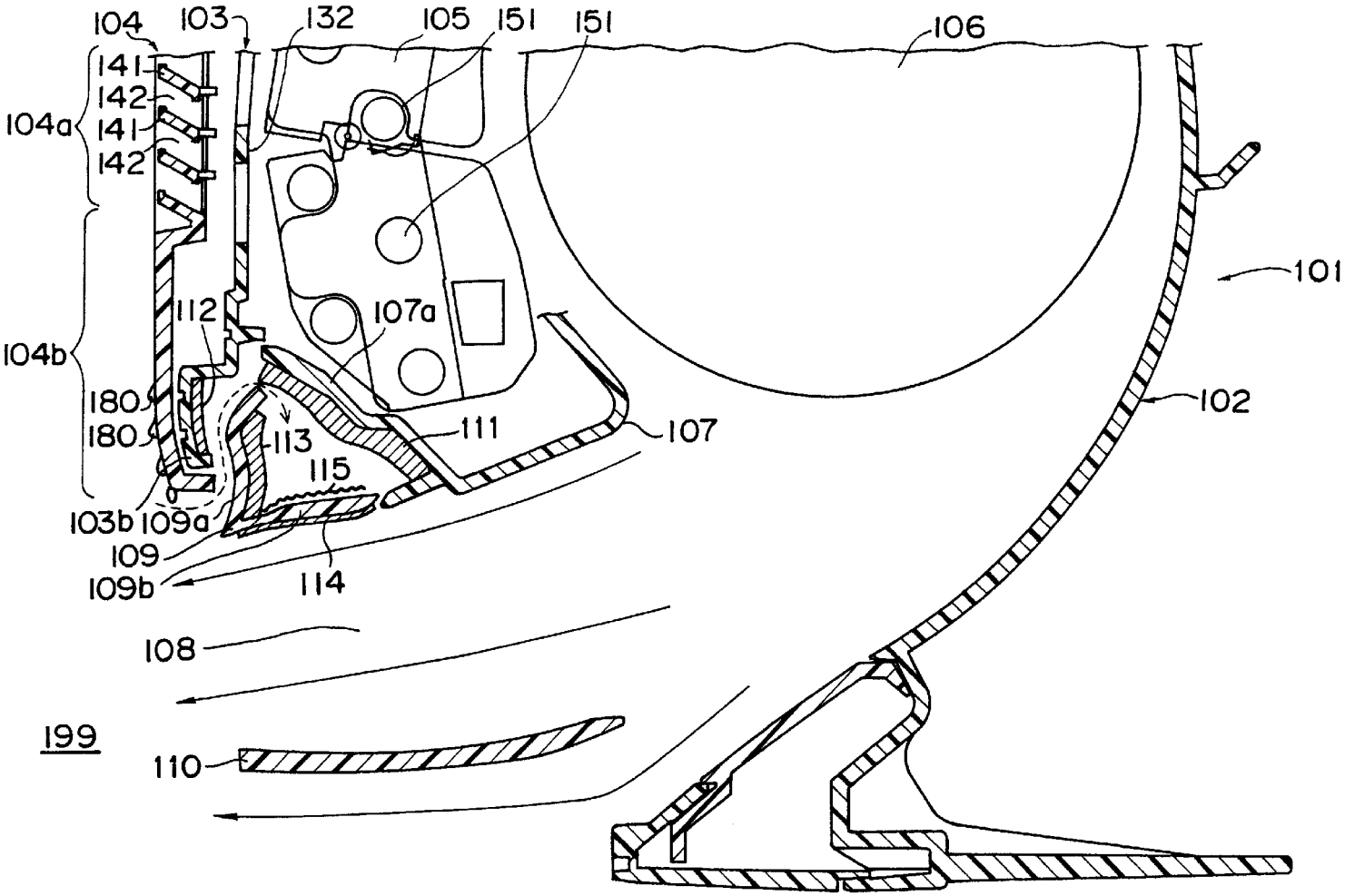
FIG. 2 is a sectional view showing an indoor unit for air conditioners according to the prior art.

FIG. 1 shows an indoor unit 1 for a separate type air conditioner in an embodiment. For an easier understanding, FIG. 1 illustrates a cross section of the indoor unit 1, as a generally lower half thereof is viewed from the right side.

This indoor unit 1 comprises, in a unit casing 2, an air fan (cross flow fan) 6, and a bent-type heat exchanger 5 disposed on a drain pan 7. The heat exchanger 5 is bent so as to surround the periphery of the air fan 6, being opposed to the air fan 6 over a range from the front face to an unshown top face of the periphery of the air fan 6. Through a heat exchanger tube 51 of the heat exchanger 5, a low-temperature refrigerant for cooling operation or a high-temperature refrigerant for heating operation is passed by a refrigerant circuit in conjunction with an unshown outdoor unit. The drain pan 7 has a front portion 7*a* tilted front-to-rear obliquely downward, a bottom portion 7*b* adjacent to this front portion 7*a* and tilted front-to-rear obliquely upward, and a rear portion 7*c* adjacent to this bottom portion 7*b* and extending rear-to-front obliquely upward. A heat insulating material 11 is applied to the lower face of the drain pan front portion 7*a*.

A front grille 3 is provided in front of the heat exchanger 5, and a front panel 4 is provided further in front of the front grille 3. In the front panel 4, a suction grille for sucking indoor air is formed over a range from a central portion 4*a* to an unshown upper portion of the front panel 4. This suction grille comprises a plurality of louvers 41, 41, . . . extending in horizontal directions perpendicular to the drawing sheet of the figure and tilted front-to-rear obliquely downward. These louvers 41 are arranged above and below at a constant pitch, where gaps 42, 42, . . . for ventilation are provided between adjacent louvers 41, 41. Because the indoor unit 1 is generally installed in proximity to the ceiling in a room, the front panel 4 of the indoor unit 1 can be seen obliquely from front below. Accordingly, the user cannot see the gaps 42, 42, . . . between the louvers 41, 41, . . . In a front panel lower portion 4*b* adjoining the front panel central portion 4*a*, dips and bumps 43, 44 showing the same appearance as the suction grille are formed in continuation to the suction grille of the front panel central portion 4*a*. These dips and bumps 43, 44 comprise a first tilted portion 43 extending in a horizontal direction perpendicular to the drawing sheet of the figure and tilted front-to-rear obliquely downward, and a second tilted portion 44 tilted front-to-rear obliquely upward so as to connect a rear edge of the upper-side first tilted portion 43 to a front edge of the lower-side first tilted portion 43 between adjacent first tilted portions 43, 43, . . . The first tilted portions 43 are arranged at the same pitch as the louvers 41, in correspondence to the louvers 41 of the suction grille. The second tilted portions 44 are not seen obliquely from front below, like the gaps 42 of the suction grille. As a result of this, the suction grille 41, 41, . . . of the front panel central portion 4*a* and the dips and bumps 43, 44 of the front panel lower portion 4*b* show the same appearance, so that the front panel 4 is not spoiled in its external look. Also, the front panel 4 is integrally molded into a state including the suction grille 41, 41, . . . and the dips and bumps 43, 44, thus are easy to manufacture.

In addition, the front panel 4 is opened relative to the unit casing 2 by the user pulling its lower portion toward the user (forward of the indoor unit 1), and closed relative to the unit casing 2 by the reverse operation.

The front grille 3 is a plate-shaped member integrally mounted to the unit casing 2. A portion 3*a* of the front grille 3 which is opposed to the central portion 4*a* to upper portion of the front panel 4 is formed into a shape of a lattice 31, and windows 32 for ventilation are provided between those lattice frames 31. A lower portion 3*b* of the front grille 3 is formed generally flat-shaped without having windows, and overlaid on the front panel lower portion 4*b*.

An air outlet 8 of this indoor unit 1 is formed obliquely forward and downward under these overlaid front panel lower portion 4*b* and front grille lower portion 3*b* and the drain pan 7.

A diffuser 9 having an inverted T-shaped cross section is provided at a position on a front panel 4 side within the air outlet 8, more specifically, between the front grille lower portion 3*b* and the drain pan front portion 7*a*. This diffuser 9 works to change kinetic energy fed to the blown-off air into pressure. Meanwhile, a generally flat-shaped guide vane 10 is provided at a lower portion within the air outlet 8. The guide vane 10 can change the angle of the blown-off air by turning around an axis 10*a*.

During the cooling operation, a low-temperature refrigerant is passed through the heat exchanger tube 51 of the heat exchanger 5 of this indoor unit 1. In this state, with the air fan 6 driven into rotation, indoor air is sucked in through the gaps 42 of the suction grille of the front panel 4 and the windows 32 of the front grille 3 (the flow of sucked air is indicated by an arrow 90), and air 91 cooled through the heat exchanger 5 is blown out into a room 99 through the air outlet 8 located below the front panel 4 (the flow of blown-off air is indicated by an arrow 91). Because the front panel lower portion 4*b* has neither gaps nor windows 32, there occurs no ventilation through the front panel lower portion 4*b* so that the ventilation as has been conventional is enabled.

A portion 91*a* of the blown-off air flows through the gaps between the diffuser 9 and the drain pan front portion 7*a* or the front grille lower portion 3*b*. As a result of this, the blown-off air flows at a lower flow velocity on the rear face side of the front grille lower portion 3*b*, so that the rear face side of the front grille lower portion 3*b* is cooled relatively strongly. However, the front panel lower portion 4*b*, because of its dip-and-bump shape, has an increased area of contact with the indoor air on the front face side of the front panel lower portion 4*b*. Accordingly, the front-face side temperature (surface temperature) of the front panel lower portion 4*b* rises higher, as compared with the case where the front panel lower portion 4*b* is flat-shaped. Also, because the contact area between the front panel lower portion 4*b* and the front grille lower portion 3*b* becomes smaller as compared with the case where the front panel lower portion 4*b* is flat-shaped, cold is less transferable from the front grille lower portion 3*b* to the rear face side of the front panel lower portion 4*b*. Therefore, the front-face side temperature of the front panel lower portion 4*b* rises even further higher, making it unlikely that dew condensations occur to the front face side of the front panel lower portion 4*b*. As a result, heat insulating materials on the rear face side of the front grille lower portion 3*b* can be omitted as in this example, allowing a cost reduction.

As a result of an experiment of actual cooling operation, even when the rear-face side temperature of the front grille lower portion 3*b* became 12° C., the front-face side temperature of the front panel lower portion 4*b* was able to maintain 27° C. and no dew condensations occurred to the front face side of the front panel lower portion 4*b*.

In addition, it is also possible that the contact area between the front panel lower portion 4*b* and the front grille lower portion 3*b* is reduced by forming the front panel lower portion 4*b* into a flat shape and, instead, forming the front grille lower portion 3*b* opposed to the front panel lower portion 4*b* into a dip-and-bump shape.

Also, in the present invention, the front grille lower portion 3*b* has only to be a member opposed to the front panel lower portion 4*b*, and not limited to a plate-shaped member integrally mounted to the unit casing.

Furthermore, during heating operation, a high-temperature refrigerant is passed through the heat exchanger tube 51 of the heat exchanger 5 of this indoor unit 1. In this state, with the air fan 6 driven into rotation, indoor air is sucked in through the gaps 42 of the suction grille of the front panel 4 and the windows 32 of the front grille 3, and air 91 increased in temperature through the heat exchanger 5 is blown out into the room 99 through the air outlet 8 located below the front panel 4.

What is claimed is:

1. An indoor unit for an air conditioner, comprising a front panel (4) having a suction grille (41) at least at a central portion (4*a*), and being operative to suck in indoor air through gaps (42) of the suction grille of the front panel (4) and to blow out cooled air into a room (99) through an air outlet (8) located below the front panel (4), characterized in that a lower portion (4*b*) of the front panel (4) opposed to a lower portion (3*b*) of a front grille (3) in proximity to an upper portion of the air outlet (8) is shaped so as to have dips and bumps.

2. The indoor unit for an air conditioner according to claim 1, wherein the front panel lower portion (4*b*) shows the same appearance as the suction grille (41) and has no gaps.

3. The indoor unit for an air conditioner according to claim 1, wherein a diffuser (9) is provided at a position on one side in the air outlet (8) closer to the front panel (4).

* * * * *